United States Patent [19]

Moore et al.

[11] 4,140,114

[45] Feb. 20, 1979

[54] DIVING UMBILICAL CABLE

[75] Inventors: Boyd B. Moore; Clarence E. Kendall, Jr., both of Houston, Tex.

[73] Assignee: Custom Cable Company, Houston, Tex.

[21] Appl. No.: 816,848

[22] Filed: Jul. 18, 1977

[51] Int. Cl.[2] ..... A62B 7/12; B63C 11/18

[52] U.S. Cl. ..... 128/145 R; 128/142.7; 138/112; 174/47; 285/188; 405/186

[58] Field of Search ..... 128/140 R, 142.3, 142.4, 128/142.7, 145 R, 145 A, 147, 142 R, 142.5; 138/112; 174/47 R, 188, 112 R; 285/188; 61/69 R, 69 A, 71

[56] References Cited

U.S. PATENT DOCUMENTS

| | | | |
|---|---|---|---|
| 1,959,302 | 5/1934 | Paige | 138/112 X |
| 2,197,392 | 4/1940 | Hawthorn | 174/47 X |
| 2,628,998 | 2/1953 | Frisbie | 174/112 R |
| 2,916,055 | 12/1959 | Brumbach | 174/112 X |
| 3,526,086 | 9/1970 | Morgan | 174/47 R |

FOREIGN PATENT DOCUMENTS

| | | | |
|---|---|---|---|
| 364234 | 1906 | France | 61/71 R |
| 161534 | 12/1957 | Sweden | 174/113 R |
| 830651 | 3/1960 | United Kingdom | 174/112 |

*Primary Examiner*—Henry J. Recla

*Attorney, Agent, or Firm*—Fulbright & Jaworski

[57] ABSTRACT

A diving umbilical cable suitable for supporting an underwater diver and, at the same time, supplying lines for air supply, depth measuring and communication elements such as, but not limited to, telephone wires, television coaxial cable, and fiberoptic bundles. The air supply line is a standard load bearing hose whose axis is substantially the same as that of the umbilical cable, around which are helically disposed any number of elements. Such elements are longer per unit length of the diving umbilical cable than is the center load bearing hose. Extruded over the center load bearing hose with the helically wrapped elements is a protective jacket which assists in maintaining the helically wrapped elements in position and, at the same time, protects them from wear and tear. The protective jacket is perforated along its length so that air may escape when the umbilical cable is lowered into the water and water may escape when the diving umbilical cable is pulled from the water.

6 Claims, 3 Drawing Figures

DIVING UMBILICAL CABLE

BACKGROUND OF THE INVENTION

When a diver receives life support from the surface it is necessary to provide an air supply and a means for lowering and raising the diver in and out of the water. In normal diving operations both functions are usually performed by suspending the diver from a load bearing air hose. Furthermore, it is also necessary or desirable to provide a means for gauging the diver's depth, operating television cameras under water, and communicating with wires and fiberoptic bundles as may be required for any particular underwater operation (hereinafter referred to as "elements"). It is preferable for the load bearing air hose and the desired elements to be assembled into one umbilical cable for convenience as well as safety. It is desirable that the outer diameter of the umbilical cable have a configuration which facilitates the lowering and raising of the umbilical cable by hand.

STATEMENT OF THE PRIOR ART

Typically, underwater diving operations utilize a rubber, reinforced, load bearing air hose with other desired elements, such as hoses for depth gauging, coxial cables and electrical conduits, all axially aligned with the air hose. The entire bundle consisting of the air hose and the various elements are hand taped together at frequent intervals. Although this combination is presently used, it has several undesirable qualities. The air hose and elements are exposed to wear, tear and possible injury. Moreover, its configuration makes it particularly susceptible to catching on objects such as rocks, coral, underwater wreckage and man made sub-sea structures.

Hand taping the combination of the air hose and elements together contributes to breaking the elements. The load bearing air hose is aligned with the non-load bearing elements and elongates under tensional load and causes elongation and consequent breakage of the elements. The parallel arrangement is also unsatisfactory for hand lowering and raising the diver because the bundle is difficult to grip.

Adverse bending characteristics is another shortcoming of the taped parallel bundle. When it is bent, the outermost element is subjected to axial tension. Conversely, the innermost element is subjected to axial compression. The outer members and inner members are thus forced together when the cable is bent so that the inner member exerts an even greater load upon the outer member or, alternatively, the inner member may be displaced out of its parallel alignment so that it overlaps an outer member. Kinking of the inner member is a characteristic of wires, hoses, and other similar apparatus which, when under axial compression, tend to respond thereto by point displacement. The result is that the configuration of the taped parallel bundle changes and the reconfiguration in turn tends to unravel the bundle from its tape binding. Moreover, the forcing of the compressed elements against the elements under tension placed additional stress upon conductors and tends to restrict the air hose and depth measuring hose.

There have been attempts to remedy some of the aforementioned problems by enclosing an air hose and associated elements in a protective jacket. Those configurations involve a parallel construction similar to the taped bundle and have most of the shortcomings of the taped bundle. Other configurations employ a helical arrangement of the breathing line and elements. Such arrangements have a common helix; i.e., the air hose and elements are cabled together without having a load bearing center element. Consequently, when tension is applied to the arrangement the entire combination tends to elongate and produces a change in configuration which in turn may restrict the air hose. More importantly, however, the length of the load bearing air hose and the length of the elements is approximately the same. When the load bearing air hose is not the shortest member in the arrangement, the non-load bearing elements are frequently broken or otherwise damaged when the arrangement is subjected to tension.

SUMMARY OF THE INVENTION

The present invention is an integral diving umbilical cable (hereinafter sometimes referred to as "umbilical") suitable for raising and lowering a diver into and out of the water and which contains an air hose and all necessary elements for a particular underwater task.

It is an object of the present invention to have a load bearing air hose whose axis is substantially the same as that of the umbilical cable. The air hose is the shortest member per unit length of the diving umbilical cable thereby tending to cause the load bearing air hose to support the tensional loads placed upon the diving umbilical cable without such load being transmitted to any of the other elements.

It is a further object of the present invention to wrap helically all of the necessary elements around the load bearing air hose. By this construction the elements themselves are subjected to little or no tensional load so that stretching the load bearing air hose tends to let the helically wrapped elements elongate like a stretched coil spring and not break.

Still another object of the present invention is to arrange helically the elements around the center air hose thereby reducing kinking of the elements when the umbilical cable is bent.

A still further object of the present invention is to dispose a substantially transparent protective jacket around the air hose and helically wrapped, color coded elements such that the elements can visually be inspected. This facilitates umbilical cable identification, inspection of condition and locating possible damage.

An even further object of the present invention is to enclose the diving umbilical within a protective jacket which is perforated periodically along and around its circumference permitting air to escape when the umbilical cable is lowered and water to drain as the umbilical is raised from the water.

Further objects and advantages of the present invention shall become apparent from the following descriptions, drawings and claims.

DESCRIPTION OF THE PREFERRED EMBODIMENTS

Figure 1:
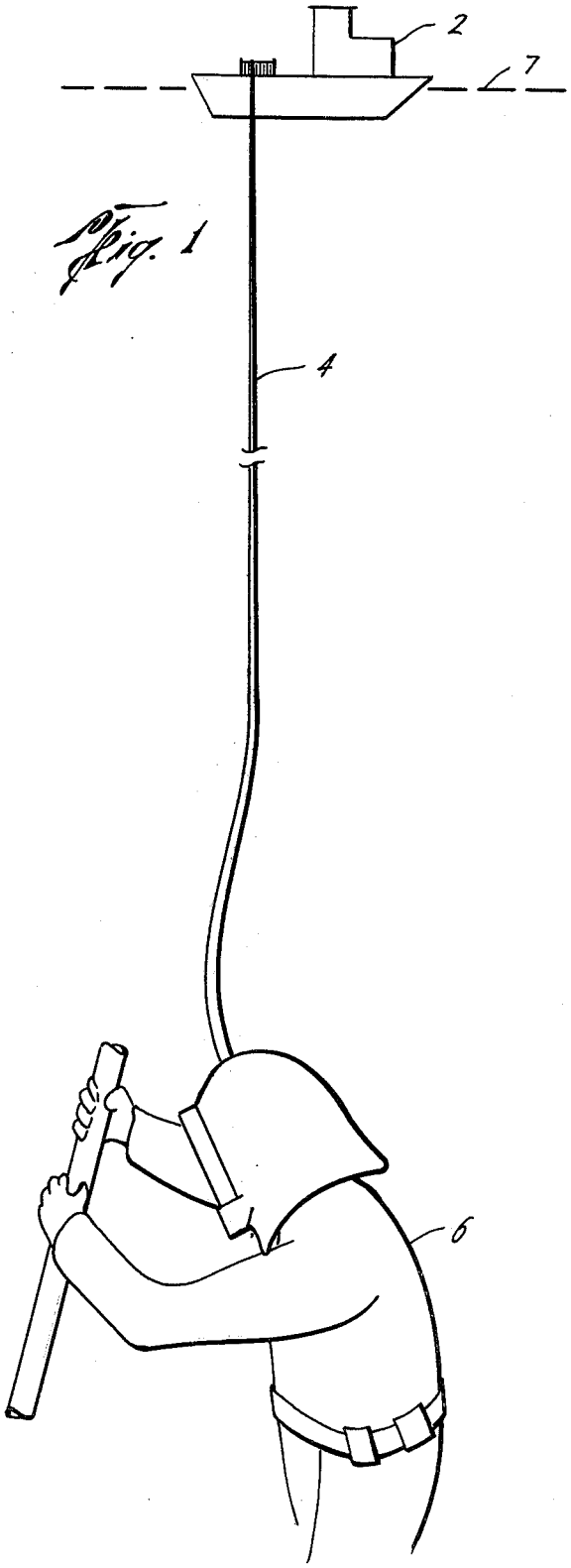
FIG. 1 is an environmental view depicting a surface ship, a diving umbilical cable hand-deployed into the water and an underwater diver tethered to the surface ship by means of the umbilical cable.
Figure 2:
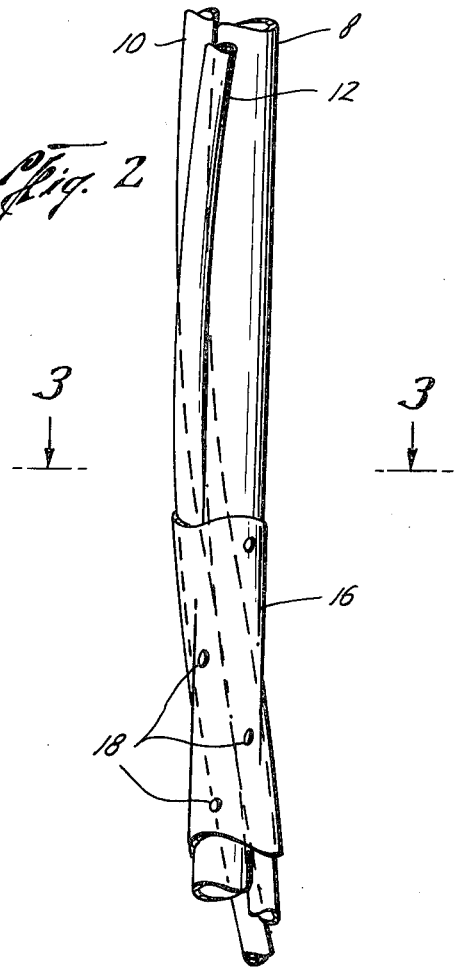
FIG. 2 is an elevational view of the diving umibilical cable in partial section.
Figure 3:
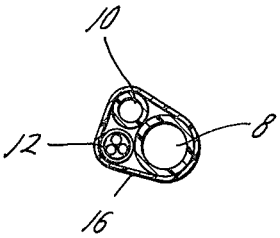
FIG. 3 is a cross sectional view of the diving umbilical cable taken along line 3—3.

Turning now to the drawings, FIG. 1 shows surface ship 2 carrying the diving umbilical 4 which in turn has been lowered below the surface of the water 7 tethering the diver 6 to the ship 2. The use of a sheave or conveyor onboard the ship 2 is generally not required, the diver 6 being lowered or raised by hand manipulation of the umbilical 4.

The umbilical 4 comprises a flexible load bearing air hose 8 whose axis is substantially the same as the axis of the umbilical cable. The air hose 8 is the primary means for supporting the weight of the diver and raising and lowering him during diving operations. The air hose 8 also transmits the air supply from the ship 2 to the diver 6. Helically wrapped around the air hose 8 are the auxiliary elements which, in this case, consist of a hose used in determining water depth 10, and a voice communication wire 12. It is understood by those skilled in the art that, depending upon the particular task to be performed underwater, any number or combination of elements can be used in lieu of or in addition to those which are shown herein for purposes of illustration only. As depicted in the drawings, the helically wrapped elements 10 and 12 are uniformly wrapped around the entire length of the air hose 8 and all possess substantially the same pitch angle.

It can easily be seen that the air hose 8 is shorter than any of the helically wrapped elements 10 and 12 for any given length of the diving umbilical 4. Consequently, when tensional load is applied to the diving umbilical 4, the tensional load is immediately transferred to the air hose 8. The air hose 8, which is preferably a flexible rubber hose with reinforcement, elongates when tension is applied to it. During the elongation of the air hose 8, the elements 10 and 12 are not subjected to tensional loads by virtue of their helical disposition but, instead, are subjected to a change in their pitch angle as they tend to elongate similar to a stretched coil spring. The construction of the umbilical cable permits it to elongate, tends to reduce the breaking of the air hose or the elements and thus provides a shock absorber effect which makes it safer than other kinds of diving assemblies. Those skilled in the art will readily see that upon releasing the tensional load placed upon the umbilical cable 4, the arrangement of the air hose 8 and the elements 10 and 12 is substantially the same as it was prior to the application of the tensional load.

When the umbilical 4 is bent, the air hose 8 in the center reduces kinking and radial force loads which normally result from the difference in radius resulting from bending two fixed parallel members. Those skilled in the art realize that bending the umbilical 4 causes a relative axial displacement between the air hose 8 and the elements 10 and 12 but, at the same time, the overall arrangement is unchanged and, therefore, the overall integrity of the umbilical 4 is maintained.

When a tensional load is applied to the umbilical 4, the tightening of the elements 10 and 12 around the air hose 8 as a consequence of the change in the pitch angle of the elements 10 and 12 causes sufficient radial loading of the air hose 8 so that the air hose 8 becomes somewhat helical itself. Upon release of the tensional load, the configuration of the umbilical 4 is substantially the same as it was prior to the application of the tensional load.

A protective jacket 16 is extruded onto the air hose 8 with helically disposed elememts 10 and 12 so that the exterior of the umbilical 4 has continuous helical ribs. The helically ribbed exterior of the umbilical 4 facilitates the handling of the umbilical by improving the gripping characteristics in comparison to slick surfaces and taped parallel combinations.

Preferably, the umbilical 4 will carry color coded elements such as, but not limited to, those elements 10 and 12, as described above. Furthermore, it is preferable for the protective jacket 16 to be substantially transparent in order that the operator can quickly and easily inspect the elements of the umbilical cable 4 to insure that the correct cable has been selected for a particular underwater task, that the condition of the elements in the cable is satisfactory for operations and to locate quickly those places where damage may have occurred.

It is preferred that the protective jacket 16 contains perforations 18, which can be of any pattern or diameter within the spirit of this invention. The perforations 18 reduce the buoyancy of the diving umbilical cable 4 as the cable is lowered into the water by permitting air within the umbilical cable 4 to escape therefrom. Conversely, as the cable 8 is raised from the water, seawater is able to depart the interior of the cable through the perforations 18 thereby reducing the weight of the cable once it is out of the water.

A flame retardant jacket is desirable as the diver is frequently involved in underwater welding operations conducted in a below surface air environment. The umbilical 4 may be damaged or severed by contact with high temperature devices for cutting and welding operated by the diver. Accordingly, the preferred material for the protective jacket 16 is a flame retardant water resistant polyurethane.

A preferred embodiment of the present invention is a diving umbilical cable 4 having a centered, load bearing, flexible, reinforced, rubber-like air hose, such as the SAE 100 R3 commonly in use today, whose axis is substantially the same as that of the umbilical, any number of elements, for example 10 and 12, helically wrapped around the air hose 8 and having a uniform pitch angle, a water resistant, flame retardant, substantially transparent polyurethane jacket 16 extruded onto the air hose 8 and any number of helically disposed elements, for example 10 and 12 and the jacket 16 having perforations 18 which assist in the draining of water from the umbilical 4 upon extraction of the umbilical from the water. The commercially available SAE 100 R3 type hose conforms to specification no. SAE J517c of the Society of Automotive Engineers.

Although for purposes of illustration and example certain limited and preferred embodiments have been disclosed heretofore, it should be understood that any embodiment, modification or arrangement within the spirit of the invention and claimed herein falls within the scope of the claimed diving umbilical cable.

What is claimed is:

1. A diving umbilical cable comprising:

(a) a rubber-like load bearing hose substantially aligned along the axis of the umbilical cable having a first end including means for connecting to a supply of breathing gas and a second end including means for connecting to a diver's headgear;

(b) auxiliary elements helically disposed around the rubber-like hose (a) such that (i) the helically disposed elements have a substantially uniform pitch angle; and (ii) the helically disposed elements are longer per unit length of the umbilical cable than the rubber-like hose (a);

(c) a flame retardant rubber-like jacket incompassing and containing the combination of the rubber-like load bearing hose (a) and the helically disposed elements (b); and (d) a plurality of perforations along the length of the flame retardant jacket (c) which permit the drainage of a liquid from the umbilical cable as the cable is raised from the liquid and permit the escape of air from the umbilical cable when the cable is lowered into the liquid.

2. The apparatus of claim 1 wherein the air hose (a) is an SAE 100 R3 rubber hose.

3. The apparatus of claim 1 wherein the protective jacket (c) is water resistant.

4. The apparatus of claim 1 wherein the protective jacket (c) is flame retardant polyurethane.

5. The apparatus of claim 1 wherein the protective jacket (c) is substantially transparent.

6. The apparatus of claim 5 wherein the helically disposed elements (b) are color coded for easy identification as viewed through the substantially transparent protective jacket (5).

* * * * *